United States Patent [19]

Tetsuo

[11] 4,186,197

[45] Jan. 29, 1980

[54] VIBRATION RAM

[76] Inventor: Susumu Tetsuo, 17-1, Kita Senzoku 3, Ohta-ku, Tokyo, Japan

[21] Appl. No.: 973,701

[22] Filed: Dec. 27, 1978

[51] Int. Cl.[2] ..... E01C 19/34

[52] U.S. Cl. ..... 404/133

[58] Field of Search ..... 404/133, 117; 74/87

[56] References Cited

U.S. PATENT DOCUMENTS

| | | | |
|---|---|---|---|
| 2,845,050 | 7/1958 | Wacker | 404/133 |
| 3,162,102 | 12/1964 | Juneau | 404/133 |
| 3,277,801 | 10/1966 | Horvath | 404/133 |
| 3,308,729 | 3/1967 | Kestez | 404/133 |
| 3,538,821 | 11/1970 | Baeumers | 404/133 |
| 3,630,127 | 12/1971 | Yamato | 404/133 |
| 3,636,834 | 1/1972 | Waschulewski | 404/133 |
| 4,014,620 | 3/1977 | Vural | 404/133 |

*Primary Examiner*—Nile C. Byers, Jr.
*Attorney, Agent, or Firm*—Armstrong, Nikaido, Marmelstein & Kubovcik

[57] ABSTRACT

A vibration ram having an engine, a downwardly extending outer cylinder fixedly attached to the engine and an inner cylinder slidably mounted within the outer cylinder. A foot plate is attached to a lower end of the inner cylinder for contacting and tamping a ground surface. A top plate having an opening partially closes an upper end of the inner cylinder. An operating rod slidably extends through the top plate opening. The operating rod is reciprocatingly driven by the engine. An upper stop member is positioned on an upper portion of the operating rod and a lower stop means is provided on a lower portion of the operating rod spaced from the upper stop member. Upper and lower slide members are slidably mounted on the operating rod. The upper slide member is adapted to abut against the upper stop member, while the lower slide member is adapted to abut against the lower stop member. A partially compressed spring element is positioned between the upper and lower slide members and urges the upper and lower slide members into abutment with the upper and lower stop members. A seat member is fixedly positioned on the lower end of the inner cylinder for limiting the lower movement of the lower slide member independently of the lower stop member.

4 Claims, 5 Drawing Figures

VIBRATION RAM

BACKGROUND OF THE INVENTION

1. Field of the Invention

This invention relates to a vibration ram used for tamping or compacting the ground in road building and other construction works.

2. Description of the Prior Art

There are known in the art vibration rams of the type in which an inner cylinder is slidably inserted into an outer cylinder. The inner cylinder having inserted thereinto a piston rod connected through a connecting member to a connecting rod hinged to a crank to which the rotative force of an engine is transmitted through a gearing mechanism or a belt pulley assembly. Coil springs compressed with a predetermined compression force are interposed between the piston secured to an end of the piston rod and the top and bottom plates of the inner cylinder such that the upper and lower coil springs will be alternately compressed by the piston in accordance with the reciprocating movement of the engine-driven piston rod. The inner cylinder is vibrated by the repulsive force of the compressed coils springs to accordingly move a foot plate secured to the lower end of the inner cylinder to thereby effect the desired tamping of the ground.

In these known types of rams, however, since coil spring units are provided on both the upper and lower sides of the piston, it is necessary to elongate both the inner and outer cylinders by an amount corresponding to the height of the two coil spring units. This results in both an elevated position of the center of mass of the ram device and an increase in the weight thereof. This increased height and weight requires a great deal of extra labor and inconvenience to the ram operator. Referring to Fig. 1, supposing that the center of mass of the ram is G, the position at which the operator grips the operating handle for supporting the ram is A and the end point of the foot plate is B; then the ram has a moment of $W(x_1)$ urging it to rotate counterclockwise about the point B when the foot plate impacts against the ground surface. In order to resist this turning force, the operator is required to apply a force P to the ram equal to $(x_1/x_2)W$. Thus, the smaller the value of P, the less labor is required by the operator; but since the distance $x_1$ is increased when the center of mass G is high, the value of P is accordingly increased.

The problem becomes more severe because the ground to be tamped by a ram is usually rugged and of irregular solidness; and further, the area of the foot plate portion engaged with the ground surface is kept small to increase the tamping force applied per unit of area relative to the size of the ram body. Further, the ram body has a tilted low-stability structure for providing a tendency to advance in a forward direction while in operation. Further, the high center of gravity makes the device not only unstable both in the rearward and force-applying directions as described above, but also tends to turn over in all other directions, so that the operator is required to exercise a great deal of effort to prevent such overturn.

Thus, for the above-discussed reasons, lowering of the center of mass and reduction in wieght have been important objects for improvement in the field of rams.

SUMMARY OF THE INVENTION

An object of the present invention is to provide a vibration ram having improved stability and ease of operation by lowering the position of the center of mass of the ram by reducing the size of the inner and outer cylinders.

Another object of the invention is to provide a vibration ram which does not require as much effort for transport and operation thereof by reducing the weight of the ram.

Still another object of the invention is to provide a ram having an increased impact load by increasing the leap-up height and stay-in-the-air time through the provision of a Belleville spring unit.

Yet another object of the invention is to provide a ram which permits easy substitution of springs having characteristics best suited to the condition of the ground to be tamped through the use of a Belleville spring unit.

A further object of the invention is to provide a ram having a new construction using only a single spring unit.

A still further object of the invention is to provide a ram employing a coil spring and Belleville spring in the ram mechanism.

More specifically, the present invention is directed to a vibration-type ram having an engine, a downwardly extending outer cylinder fixedly attached to the engine and an inner cylinder slidably mounted within the outer cylinder. A foot plate is attached to a lower end of the inner cylinder for contacting and tamping a ground surface. A top plate having an opening partially closes an upper end of the inner cylinder. An operating rod slidably extends thru the top plate opening. The operating rod is reciprocatingly driven by the engine. An upper stop member is positioned on an upper portion of the operating rod and a lower stop means is provided on a lower portion of the operating or spaced from the upper stop member. Upper and lower slide members are slidably mounted on the operating rod. The upper slide member is adapted to abut against the upper stop member, while the lower slide member is adapted to abut against the lower stop member. A partially compressed spring element is positioned between the upper and lower slide members and urges the upper and lower slide members into abutment with the upper and lower stop members. A seat member is fixedly positioned on the lower end of the inner cylinder for limiting the lower movement of the lower slide member independently of the lower stop member.

BRIEF DESCRIPTION OF THE DRAWINGS

These and other objects and advantages of the invention will become more fully apparent as the following description is read in conjunction with the drawings, wherein.

DESCRIPTION OF THE PREFERRED EMBODIMENTS

Figure 2:
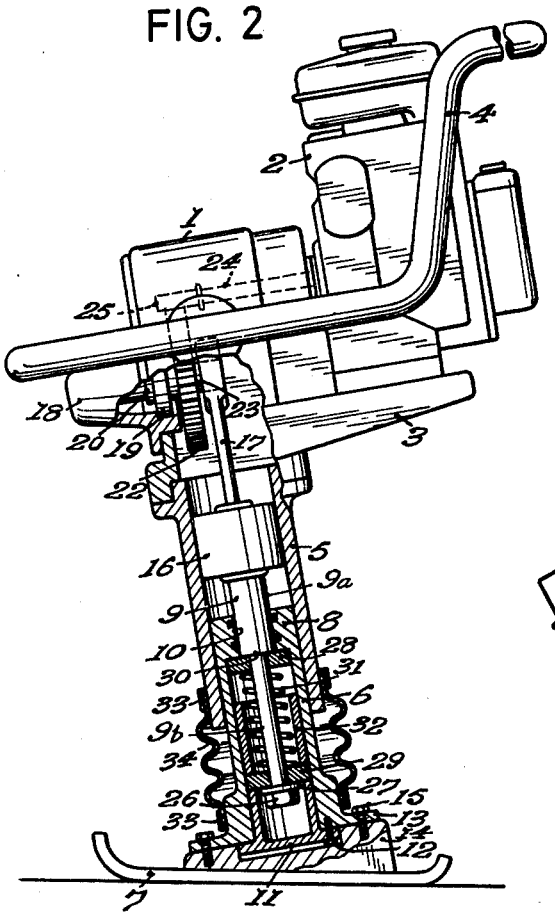
FIG. 2 is a side view, partly in section, showing the internal structure of a ram which is provided with a coil spring, according to the invention.
Figure 1:
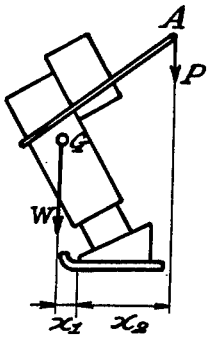
FIG. 1 is a schematic side view of a typical vibration ram showing the positional relation between the center of mass and the various ram elements.

As illustrated in FIG. 2, a crank case 1 and an engine 2 are mounted on a support block 3. An operating handle 4 is mounted on the crank case 1. A downwardly extending outer cylinder 5 is secured in a lower portion of the crank case 1.

Slidably mounted in the outer cylinder 5 is an inner cylinder 6. A foot plate 7 is secured to a lower or bottom end of the inner cylinder 6. It will be seen that both the outer cylinder 5 and the inner cylinder 6 are forwardly slanted relative to the foot plate 7.

A top plate 8 partly closes the upper end of the inner cylinder 6. The top plate 8 is provided with an hole or opening 10 through which an operating rod 9 slidably passes. A flanged cup-shaped seat 11 closes the bottom opening of the inner cylinder 6. The flange of the cup-shaped seat 11 is secured to the bottom of the inner cylinder 6 by means of bolts 12. The bottom end of the inner cylinder 6 includes a flange 13 to which a foot plate fixing plate 14 is secured by means of bolts 15.

The operating rod 9 extends into the inner cylinder 6 through the opening 10. The operating rod 9 is secured to a connecting member 16. The connecting member 16 is arranged to slide along an inner surface of the inner cylinder 6. A connecting rod 17 has a lower end pivotally attached to the connecting member 16. An upper end of the connecting rod 17 is rotatably connected to a crank pin 23. The crank pin 23 is eccentrically secured to a gear 22 mounted on a shaft 20 supported by bearings 19 in a bearing unit 18. A pinion gear 25 secured to the engine drive shaft 24 drivingly engages with the gear 22. Thus, the gear 22 is rotated upon actuation of the engine 2 to cause the connecting rod 17, connecting member 16 and operating rod 9 to reciprocate or move up and down.

The operating rod 9 includes a large diameter upper portion 9a and a smaller diameter lower portion 9b. A disc-shaped outer stop member 27 held in position by a nut 26 is provided at the lower end of the operating rod smaller diameter lower portion 9b. Two annular slide members 28, 29 are slidably fitted on the smaller-diameter portion 9b of the operating rod 9. The upper slide member 28 is restrained from upward movement by the stepped portion or shoulder 30 of the operating rod 9; while the lower slide member 29 is restrained from downward movement by the disc-shaped outer stop member 27. A coil spring 31 or Belleville spring is disposed between the upper and lower slide members 28 and 29. The spring 31 is provided with a predetermined compression deflection.

Also provided between said upper and lower slide members 28 and 29 is a cylindrical inner stop member 32 which has a larger inner diameter than the outer diameter of the spring 31. The height of the inner cylindrical stop member 32 is smaller than the distance between the slide members 28 and 20 in a condition where they are stopped by the outer stop member 27 and shoulder 30, respectively. The inner stop member 32 regulates the movement of the slide members 28 and 29 while preventing overdeflection of the spring 31. The inner stop member 32 may alternatively (not shown) be formed as a cylindrical body having a smaller outer diameter than the inner diameter of the spring 31 and may be slidably mounted on the smaller diameter portion 9b of the operating rod 9; or it may be fixed in a predetermined position on the operating rod 9. The lower portion of the inner cylinder 6 extending beyond the lower end of the outer cylinder 5 is surrounded by a bellows 34 which both prevents the entry of dirt and prevents relative rotation of the inner cylinder 6. The bellows 34 is secured at its upper end to the outer cylinder 5 and at its lower end of the inner cylinder 6 by means of bands 33.

In operation of the above-described vibration ram for tamping the ground, the engine 2 rotatably drives the gear 22 through the pinion 25 thereby causing the operating rod 9 to move up and down through connection with the connecting rod 17.

When the operating rod 9 is in its neutral position, as shown in FIG. 2, the slide members 28 and 20 are pressed, respectively, against the top plate of the inner cylinder 6 and the upper end of the seat 11, by the spring 31 to which an initial deflection has been given. When the operating rod 9 moves downwardly from this position, the upper slide member 28 abutting against the stepped portion 30 is accordingly pushed downwardly. Since the lower slide member 29 remains restrained on the seat 11 the spring 31 receives a compression load and is deflected, with the spring repulsive force acting on the inner cylinder 6 thereby pushing it downwardly.

Likewise, when the operating rod 9 moves upwardly from the neutral position, the lower outer stop member 27 through abutment against the lower slide member 29 causes the lower stop member 27 to move upwardly. Since the upper slide member 28 stays engaged with the top plate 8 of the inner cylinder 6, the spring 31 is given a compression load and is deflected, with the spring repulsive force acting on the inner cylinder 6 thereby pushing it upwardly.

In this way, the inner cylinder 6 is vibrated up and down by the combined action of the up and down movements of the operating rod 9 and the repulsive force of the compressed spring 31. Accordingly, the foot plate 7 secured to the inner cylinder 6 impacts against the ground surface periodically to tamp the ground.

Figure 3:
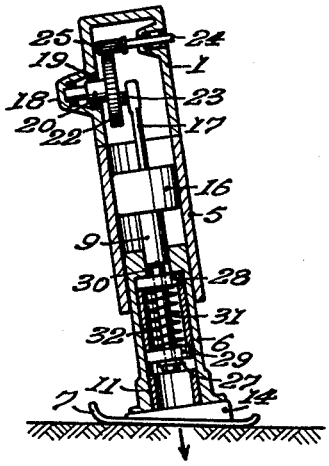
FIG. 3 is a partly schematic sectional side view showing the ram just after touching the ground surface in a normal mode of operation.
Figure 4:
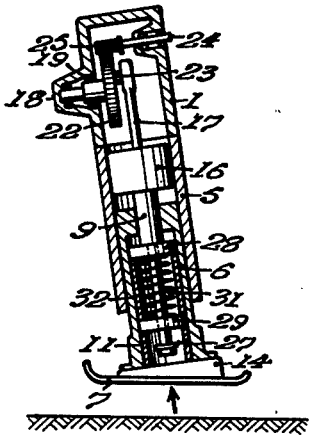
FIG. 4 is a partly schematic sectional side view showing the ram just after leaping up in a normal mode of operation.
Figure 5:
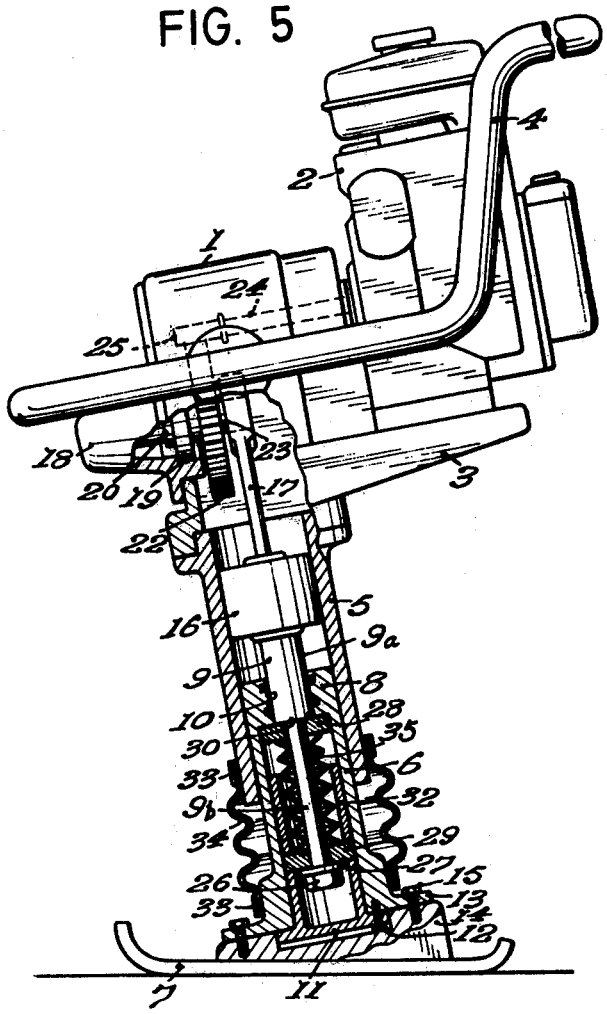
FIG. 5 is a side view, partly in section, showing the internal structure of a ram which is provided with a belleville spring according to the invention.

FIGS. 3 and 4 show operating modes of the ram in the normal operation thereof. When the inner cylinder 6 moves downwardly and outwardly from the outer cylinder 5 and the foot plate 7 impacts against the ground surface as shown in FIG. 3, the operating rod 9 reaches the lower dead center and the slide member 28 is stopped by the top plate 8 of the inner cylinder 6 while the spring 31 is compressed. Then, when the operating rod 9 begins to move upwardly relative to the outer cylinder 5, its upward movement along with the repulsive force of the compressed spring 31 and the ground surface act to the inner cylinder 6 in its upward direction to let the inner cylinder move up from the ground surface.

When the inner cylinder 6 reaches the uppermost position of its leap, the operating rod reaches the upper dead center and the inner cylinder 6 retracts into the outer cylinder 5 as shown in FIG. 4, so that slide member 28 is engaged with the stepped portion 30 of the operative rod 9 while the slide member 29 is detained by the top end of the seat 11 of the inner cylinder 6 to compress the spring 31. When the operating rod 9 again begins to descend, its descending force and the repulsive force of the compressed spring 31 act downwardly on the inner cylinder 6 to cause the inner cylinder to dash out from the outer cylinder 5 so that the foot plate 7 impacts strongly against the ground surface. The above-said operations are repeated to cause the foot plate to impact against the ground surface periodically, and thus the ram tamps the ground while gradually advancing gradually.

According to the present invention, the spring 31 will be equal in length to one of the two spring units utilized in the conventional prior art rams. Further, when a Belleville spring is used in place of the illustrated coils in spring 31, a greater amount of energy can be accumulated per unit volume than would otherwise be possible, so that if a unit amount of energy is to be accumulated by the spring, deflection can be made smaller when using a Belleville spring than when using a coil spring.

This makes it possible to shorten the time spent from the moment of engagement of the foot plate with the ground surface till the plate separates therefrom for a leap, thus allowing an increase in the stay-in-the-air time of the ram and height of its leap, thus resulting in an increased impact load given by the foot plate.

The spring characteristic of the Belleville spring unit can be varied with ease by changing the number of the springs used or by suitably combining the series and parallel arrangements thereof, and it is possible to easily select a Belleville spring having the spring characteristic that matches the condition of the ground to be tamped. When it is desired to replace the spring 31, first the bolts 15 are unfastened to remove the fixing base 14; then the bolts 12 are unfastened to remove the seat 11; and then the nut 26 is unfastened to remove the stop member 27 and slide member 29, whereafter the spring 31 can be easily removed from the inner cylinder 6.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A vibration ram comprising:

an engine;

an outer cylinder fixedly attached to said engine;

an inner cylinder slidably mounted within said outer cylinder;

a foot plate attached to a lower end of said inner cylinder;

a top plate closing an upper end of said inner cylinder, said top plate including an opening;

an operating rod slidably extending through said top plate opening, said operating rod being reciprocatingly driven by said engine;

an upper stop means positioned on an upper portion of said operating rod;

a lower stop means positioned on a lower portion of said operating rod spaced from said upper stop means;

an upper slide member slidably mounted on said operating rod, said upper slide member being adapted to abut against said upper stop means;

a lower slide member slidably mounted on said operating rod, said upper slide member being adapted to abut against said lower stop means;

a partially compressed spring means positioned between said upper and lower slide members, said spring means urging said upper and lower slide members into abutment with said upper and lower stop means, respectively; and seat means fixedly positioned relative to the lower end of said inner cylinder for limiting the lower movement of said lower slide member independently of said lower stop means.

2. A vibration ram according to claim 1, wherein said seat means is detachably mounted on the lower end of said inner cylinder.

3. A vibration ram according to claim 1, wherein said spring means is a coil spring.

4. A vibration ram according to claim 1, wherein said spring means is a set of Belleville springs.

* * * * *